United States Patent [19]

VanDyke et al.

[11] Patent Number: 5,025,856

[45] Date of Patent: Jun. 25, 1991

[54] CROSSFLOW JET IMPINGEMENT HEAT EXCHANGER

[75] Inventors: John M. VanDyke; Richard E. Niggemann, both of Rockford, Ill.

[73] Assignee: Sundstrand Corporation, Rockford, Ill.

[21] Appl. No.: 315,829

[22] Filed: Feb. 27, 1989

[51] Int. Cl.[5] ..... F28F 3/00

[52] U.S. Cl. ..... 165/167; 165/166; 165/908

[58] Field of Search ..... 165/165-167, 165/176, 908

[56] References Cited

U.S. PATENT DOCUMENTS

| | | | |
|---|---|---|---|
| 2,469,028 | 5/1949 | Belaieff | 165/176 X |
| 2,733,899 | 2/1956 | Lehmann | 165/176 X |
| 3,308,879 | 3/1967 | Maddocks | 165/167 |
| 4,162,703 | 7/1979 | Bosaeus | 165/167 |
| 4,347,897 | 9/1982 | Sumitomo et al. | 165/167 |
| 4,399,484 | 8/1983 | Mayer | 361/382 |
| 4,494,171 | 1/1985 | Bland et al. | 361/386 |
| 4,516,632 | 5/1985 | Swift et al. | 165/167 |
| 4,729,428 | 3/1988 | Yasutake et al. | 165/166 |

FOREIGN PATENT DOCUMENTS 930663 7/1973 Canada .

*Primary Examiner*—Martin P. Schwadron
*Assistant Examiner*—Allen J. Flanigan
*Attorney, Agent, or Firm*—Antonelli, Terry, Stout & Kraus

[57] ABSTRACT

A heat exchanger in accordance with the present invention transfers heat between first and second fluids (36 and 60) flowing transversely with respect to each other through a heat exchanger core (30) which is formed from a stack of a plurality of heat conductive first and second plates (32 and 34) with at least one first plate partially defining at least one first channel (55) and at least two plates each having at least one fluid orifice within each second channel (58). Each first plate comprises first and second slots which each extend through the first plate to form a passage, each first slot (52) extending across the first plate to opposed peripheral sides of the first plate and each second slot (59) extending across the first plate and not to the opposed peripheral sides. Each first slot is contained in a different first channel with the opposed peripheral sides respectively being disposed on different faces of the core and each second slot is disposed within a different second channel.

31 Claims, 15 Drawing Sheets

CROSSFLOW JET IMPINGEMENT HEAT EXCHANGER

CROSS REFERENCE TO RELATED APPLICATION

U.S. patent application Ser. No. 280,956, filed Dec. 7, 1988, entitled "Impingement Plate-Type Heat Exchanger" which is assigned to the assignee of the present invention, discloses a jet impingement type heat exchanger having a heat exchanger core in which parallel channels containing different flowing fluids each contain jet impingement structures for exchanging heat between fluids flowing through the heat exchanger core.

DESCRIPTION

1. Technical Field

The invention relates to heat exchangers for exchanging heat between two fluids flowing transversely within a heat exchanger core and to methods of manufacturing the same. More particularly, the present invention relates to heat exchangers of the foregoing type in which the efficiency of exchanging heat within the core differs with respect to direction of flow of the fluids flowing through the core.

2. Background Art

Heat exchanger cores are well known which exchange heat between two fluids which respectively flow in directions orthogonal to a heat exchanger core. FIG. 1 illustrates a prior art heat exchanger core 10 having a plate fin construction in which a first group of channels 12 receives a first fluid 14 which contacts a heat conductive plate fin corrugated structure 16 disposed within each of the channels and a second group of channels 18 receives a second fluid 20 which contacts a heat conductive plate fin structure 22 disposed within each of the channels. The heat exchanger core 10 is manufactured by brazing or other means of attaching the corrugated plate fin structures 16 and 22 to opposed faces of the channels. While the foregoing structure functions satisfactorily in exchanging heat between two fluids flowing in orthogonal directions, it suffers from a number of disadvantages. In the first place, the utilization of the corrugated plate fin structures 16 and 22, respectively, in the channels 12 and 18 results in the heat exchange performance being substantially identical in both directions of fluid flow through the heat exchanger core which can create problems in applications where the exterior dimensions of the heat exchanger core required to perform the required amount of heat exchange prevents the utilization of a heat exchanger which has substantially an identical rate of exchange in both directions of fluid flow. Furthermore, the manufacturing process for making the foregoing structure is expensive with the operations for attaching the corrugated plate fin structure complicating the manufacturing process. Finally, the efficiency of heat transfer with the corrugated plate fin structures 16 and 22 is not efficient enough for certain applications where a high heat flux must be exchanged between the two fluids in a small volume.

Jet impingement heat exchangers have been developed which utilize an impingement cooling principal for exchanging heat between different fluids flowing through the exchanger. Some heat exchangers that use the impingement cooling principal are of the impingement plate type. With the impingement plate type of heat exchanger, fluid flowing in a channel through a heat exchanger core passes through a plurality of orifices in a plate disposed across the channel to create fluid jets which strike a solid portion of a subsequent plate in the channel where the impinging fluid moves along the subsequent plate to the nearest orifice and passes through the subsequent plate for impingement against a next plate and so on. The orifices in adjacent plates are intentionally misaligned so that the fluid must impinge directly on a subsequent plate prior to passing through the orifices located therein. This misalignment forces the fluid to impinge against each plate after passing through the previous plate to provide a tortuous path for the fluid rather than permitting the fluid merely to flow through holes in the stack of plates. Eventually, after passing through a series of plates, the fluid leaves the heat exchanger. This jet impingement cooling principal substantially increases the rate of heat transfer between the fluid and each plate. The orifices may be circular. Alternatively, the orifices may be rectangular with the width being narrow and the length being much greater than the width elongated.

U.S. Pat. No. 4,516,632 discloses a heat exchanger core in the form of a polyhedron which is fabricated by stacking thin metal sheets together to form the heat exchanger core. A series of plates 14 and 16 respectively with elongated slots **14*a* and 16*a* are alternated in the stack of plates and separated by unslotted plates 12. The orientations of the plates 14 and 16** are rotated 90° with respect to the longitudinal axes of the slots therein such that ends of the slots overhang the slots of the adjacent plates. This permits the ends of the channels to be exposed by milling.

U.S. Pat. No. 4,729,428 discloses a plate fin type heat exchanger in which first and second fluids flow orthogonally through a heat exchanger core in the form of a polyhedron. Structures are disclosed for use in the channels to increase the rate of heat exchange in the channels.

U.S. Pat. No. 4,494,171, which is assigned to the assignee of the present invention, discloses a jet impingement type of heat exchanger. The heat exchanger disclosed in the '171 patent does not exchange heat between two fluids flowing in orthogonal directions. A source of coolant fluid is directed through a series of laminated plates which are joined together to form channels for conducting the cooling fluid to a device to be cooled, such as a mirror in a high energy laser. Alternating plates of the stack of plates contain a series of orifices each passing through the plate to create the jets of cooling fluid which strike each subsequent plate. After the coolant fluid strikes a surface of the device to be cooled, it is directed back to the coolant source in a direction parallel to and opposite to the direction which the fluid flowed toward the device to be cooled.

U.S. Pat. No. 4,347,897 discloses a plate-type heat exchanger which utilizes jet impingement cooling. The structure of the '897 patent utilizes pairs of fluid ports for respectively handling the first and second working fluids in the heat exchanger.

Furthermore, additional structures have been developed for plate-type heat exchangers to modify the heat exchange characteristics. It is known to provide passages between adjacent channels in which fluid is flowing through a heat exchanger core to provide a new boundary layer to enhance the heat exchange between the fluid and the surfaces of the heat conductive channel. Furthermore, it is known to provide perforations within the side walls of a channel in which fluid is flowing through a heat exchanger core to increase the turbulence of fluid flowing in the channel of the heat exchanger.

DISCLOSURE OF INVENTION

The present invention is a heat exchanger core for providing heat exchange between two fluids flowing transversely through a heat exchanger core and a method for manufacturing the same. In a preferred form, the present invention provides a heat exchanger core which has different intensities of heat transfer between the respective directions of fluid flow through the heat exchanger core. The invention permits a heat exchanger core to be configured dimensionally for applications in which a dimension of the heat exchanger core is to be minimized for the dimension running in a direction in which one of the two fluids is flowing which requires the highest intensity of heat transfer between the fluid and the walls of the heat exchanger core. The higher intensity of heat transfer is provided by incorporating a jet impingement heat exchanging structure within the walls of the heat exchanger in the direction in which the fluid is flowing which requires the higher intensity of heat transfer between the fluid and the heat exchanger. The heat exchanger disclosed in the aforementioned U.S. patent application Ser. No. 280,956 permits the different fluids to flow in the same or opposite directions through the heat exchanger core. While this structure is highly efficient in providing high heat transfer performance in a small light volume, the requirement of fluid flow in the same or opposite directions limits its utilization in many applications where it is desirable to have heat exchange between fluids flowing in a transverse, preferably orthogonal directions through a heat exchanger core. Moreover, for a jet impingement heat exchanger of the type disclosed in the foregoing patent application to perform heat exchange between fluids which are flowing in orthogonal directions with respect to the heat exchanger, headering is required to change the direction of at least one of the fluids twice by 90° in order to couple both fluids to the heat exchanger core in the same or opposite directions and redirect the fluids back to their original directions of fluid flow. The weight savings gained by using jet impingement heat exchange in the channels in which both fluids are flowing in the same or opposite directions may be lost due to the requirement of providing headering to couple the fluids to the heat exchanger core.

The present invention provides a heat exchanger utilizing jet impingement heat exchange between first and second fluids flowing through a heat exchanger core in transverse and preferably orthogonal directions. This configuration permits the dimensions of the heat exchanger core to be minimized with respect to the channels of the heat exchanger core containing the fluid requiring the greatest intensity of heat exchange per unit length within the heat exchanger core. Preferably, the heat exchanger core is fabricated by stacking and attaching plates together with fluid tight seals between plates with the plates having a series of slots and orifices which are aligned upon stacking to form fluid channels for transporting the fluids.

Furthermore, the present invention provides a process for manufacturing heat exchangers having heat exchanger cores in which first and second fluids are flowing in transverse, preferably orthogonal directions, which permits the fluid channels for the respective fluids within the heat exchanger core to be manufactured by attaching a series of plates containing slots and orifices together to form a fluid tight seal and thereafter cutting opposed sides of the plates defining opposed surfaces of a heat exchanger core covering one group of first and second groups of channels to expose the one group of channels to provide first and second groups of heat exchange channels which are transversely and preferably orthogonally disposed with respect to the heat exchanger core.

A heat exchanger for transferring heat between two fluids flowing transversely with respect to each other through a heat exchanger core in accordance with the invention includes a polyhedron having a plurality of faces which define the heat exchanger core, a first pair of faces respectively being an inlet and an outlet for the first fluid and a second different pair of faces respectively being an inlet and an outlet for the second fluid; at least one first channel extending through an interior section of the heat exchanger core between the first pair of faces for permitting the first fluid to flow between the first pair of faces with each of the at least one first channel having a plurality of heat conductive walls defining each first channel for permitting heat exchange between the walls of each first channel and the first fluid; and at least one second channel extending through the interior section of the heat exchanger between the second pair of faces for permitting the second fluid to flow between the second pair of faces with each second channel having a plurality of heat conductive walls defining each second channel for permitting heat exchange between the walls of each second channel and the second fluid, each second channel being thermally coupled to each first channel and offset from each first channel, and at least one second channel having at least one fluid orifice disposed within the second channel for forming a jet of the second fluid as fluid passes through the at least one second channel which impinges upon a heat conductive surface within the second channel. Preferably, the heat exchanger core of the invention comprises a stack of heat conductive first and second plates attached together with a fluid tight seal with at least one first plate partially defining at least one first channel and at least two second plates each having at least one fluid orifice within the at least one second channel. Further in accordance with the invention, each of the first plates comprises first and second slots which each extend through the first plate to form a passage, each first slot extending across the first plate to opposed peripheral sides of the first plate and each second slot extending across the first plate and not to the opposed peripheral sides, each first slot being contained in a different first channel with the opposed peripheral sides respectively being disposed on different faces of the first pair of faces and each second slot being disposed within one second channel. Furthermore, adjacent pairs of the second plates face at least one first plate to form the first channels; and at least one of the second plates have at least one array of orifices, each array of orifices passing through the second plate and not extending to opposed peripheral sides of the second plate with each array of orifices being aligned in fluid communication with the second slot of an adjacent first plate. The orifices of the at least one array of orifices of adjacent second plates are not axially aligned. Furthermore, at least one second plate may further comprise at least one array containing at least one opening passing through the plate and having an edge disposed between adjacent arrays of orifices; and each array of the at least one opening is contained within a different first channel to cause the first fluid to flow against the edge to create a new boundary layer when flowing through the first channel. Furthermore, at least one of the second plates may comprise at least one array of perforations disposed between adjacent arrays of orifices and aligned with a first channel, each array of perforations having at least one perforation passing through the second plate and not extending to opposed peripheral sides of the second plate containing the array of orifices to cause turbulence when the first fluid flowing through the first channel flows past the perforations.

At least one first plate may contain a number of slots equal to a number of first channels in the heat exchanger core. Each slot extends across the second plate to opposed peripheral sides of the plate with each slot being contained in a different one of the at least one first channels with the opposed peripheral sides respectively being disposed on different faces of the first pair of faces.

Furthermore, at least one of the second plates may have at least one slot extending across the second plate to opposed peripheral sides of the second plate. The opposed peripheral sides of the second plate are respectively disposed in different faces of the second pair of faces and each slot of the second plate is contained in one of the first channels.

Furthermore, the heat exchanger core may contain a plurality of first plates and at least one of the first plates comprises a plurality of slots extending through and across the first plate, and not to opposed peripheral sides of the first plate, each slot being contained in a different second channel and at least one array containing at least one opening passing through the first plate and having an edge and each array of the at least one opening is contained within a different first channel to cause the first fluid to flow against the edge to create a new boundary layer.

The heat exchanger may contain a plurality of second plates; and at least one of the second plates comprises at least one array of perforations, disposed between adjacent arrays of orifices, each array of perforations having at least one perforation passing through the second plate and not extending to opposed sides of the second plate containing the at least one array of perforations to cause turbulence when the first plate flowing through the first channel flows past the perforations.

In a preferred embodiment of the invention, the first pair of faces are parallel to each other and the second pair of faces are parallel to each other; and a plurality of first channels are disposed in the heat exchanger core with the first channels being parallel to each other and a plurality of second channels are disposed in the heat exchanger core with the second channels being parallel to each other.

A heat exchanger for transferring heat between first and second fluids flowing transversely with respect to each other through a heat exchanger core in accordance with the invention includes a polyhedron having a plurality of faces which define the heat exchanger core, a first pair of faces respectively being an inlet and an outlet for the first fluid and a second different pair of faces respectively being an inlet and an outlet for the second fluid; at least one first channel extending through an interior section of the heat exchanger core between the first pair of faces for permitting the first fluid to flow between the first pair of faces with each first channel having a plurality of heat conductive walls defining each first channel for permitting heat exchange between the walls of each first channel and the first fluid; at least one second channel extending through the interior section of the heat exchanger between the second pair of faces for permitting the second fluid to flow between the second pair of faces with each second channel having a plurality of heat conductive walls defining each second channel for permitting heat exchange between the walls of each second channel and the second fluid, each second channel being thermally coupled to each first channel and offset from each first channel; and, the heat exchanger core comprising a stack of a plurality of heat conductive first and second plates with the first plates at least partially defining at least one first channel and the second plates at least partially defining at least one second channel. Each of the first and second plates may be identical with each plate having first and second slots which each extend through the plate to form a passage, each first slot extending across the plate to opposed peripheral sides of the plate and each second slot extending across the plate but not to the opposed peripheral sides, each first slot being contained in a different first channel with the opposed peripheral sides respectively being disposed on different faces of the first pair of faces and each second slot being disposed within one second channel and each slot of a pair of plates which are the second pair of faces respectively defining an inlet and outlet for the second fluid. Preferably, the first pair of faces are parallel to each other and the second pair of faces are parallel to each other; a plurality of first channels are disposed in the heat exchanger core with the first channels being parallel to each other; and a plurality of second channels are disposed in the heat exchanger core with the second channels being parallel to each other.

A process for manufacturing a heat exchanger for transferring heat between first and second fluids flowing transversely with respect to each other through a heat exchange core with the heat exchanger core being a polyhedron having a plurality of faces which define the heat exchanger core, a first pair of faces respectively being an inlet and an outlet in the heat exchanger core for the first fluid and a second different pair of faces respectively being an inlet and an outlet in the heat exchanger core for the second fluid, at least one first channel extending through an interior section of the heat exchanger core between the first pair of faces for permitting the first fluid to flow between the first pair of faces with each first channel having a plurality of walls defining each first channel for permitting heat exchange between the walls of each first channel and the first fluid and at least one second channel extending through the interior section of the heat exchanger between the second pair of faces for permitting the second fluid to flow between the second pair of faces with each second channel having a plurality of heat conductive walls defining each second channel for permitting heat exchange between the walls of the second channels and the second fluid, each second channel being thermally coupled to each first channel and offset from each first channel comprising the steps: providing at least a plurality of plates, at least some of the plates each having at least one slot extending through the plate and extending toward opposed peripheral sides of the plate and at least one second slot extending through the plate and extending toward the opposed peripheral sides and closer to the opposed peripheral sides than the at least one first slot; stacking a plurality of the plates and attaching them together to form the first pair of faces of the polyhedron which contain the at least one first channel; and cutting a portion off the opposed peripheral sides of the stacked and attached plates to expose the at least one second slot on the surface of the second pair of faces to form the at least one second channel and not expose the at least one first channel. The stack may also contain at least one other plate with at least one of the each other plate having at least one array of orifices extending through the other plate, each array of orifices being contained within an area corresponding in position to a different first slot.

A heat exchanger for transferring heat between first and second fluids flowing transversely with respect to each other through a heat exchanger core in accordance with the invention includes a polyhedron having a plurality of faces which define the heat exchanger core, a first pair of faces each being an inlet and an outlet for the first fluid and a second different pair of faces respectively being an inlet and an outlet for the second fluid; a plurality of first channels extending through an interior section of the heat exchanger core between the first pair of faces for permitting the first fluid to flow between the first pair of faces with each first channel having a plurality of heat conductive walls for permitting heat exchange between the walls of each first channel and the first fluid; a fluid conducting mechanism for coupling the first fluid from a first fluid source to each of the first pair of faces to cause fluid to flow in opposite directions through the first channels of the interior section when the first fluid flows from the first fluid source; a fluid collecting mechanism for collecting fluid flowing from the first faces; at least one second channel extending through the interior section of the heat exchanger core between the second pair of faces for permitting the second fluid to flow between the second pair of faces with each second channel having a plurality of heat conductive walls for permitting heat exchange between the walls of each second channel and the second fluid, each second channel being thermally coupled to each first channel and offset from the first channel. Each of the second channels may function as a condenser for converting the second fluid from a gaseous state to a liquid state or as an evaporator for converting the first fluid from a liquid state to a gaseous state. The heat exchanger core includes a stack of a plurality of heat conductive plates, at least one of the plates having first and second slots which each extend through the plate to form a passage, each first slot extending across the plate to opposed peripheral sides of the plate and each second slot extending across the plate and not to the opposed peripheral sides, each first slot being contained in a different second channel with the opposed peripheral sides respectively being disposed on different faces of the first pair of faces with each second slot being disposed within a different first channel. At least one of the first channels contains at least one fluid orifice for forming a jet of the second fluid as fluid passes through the at least one second channel which impinges upon a heat conductive surface within the at least one second channel. The plurality of heat conductive plates comprise at least one first plate with each first plate containing the first and second slots and at least a pair of second plates with adjacent pairs of second plates facing at least one first plate and at least one second plate has at least one array of orifices, each array of orifices containing at least one orifice passing through the second plate and not extending to opposed peripheral sides of the second plate with each array of orifices being aligned in fluid communication with the second slot of an adjacent first plate. Each array of orifices may contain at least one opening passing through the second plate with each opening dividing the array of orifices into subparts with each opening blocking the flow of heat between subparts on both sides of the opening; and each second slot may have pairs of solid portions extending across the second slot defining an opening between the solid portions each at positions such that opposed faces of the solid portions are in registration with opposed sides of each opening in an adjacent second plate so that openings in adjacent first and second plates are aligned.

BEST MODE FOR CARRYING OUT THE INVENTION

Figure 2:
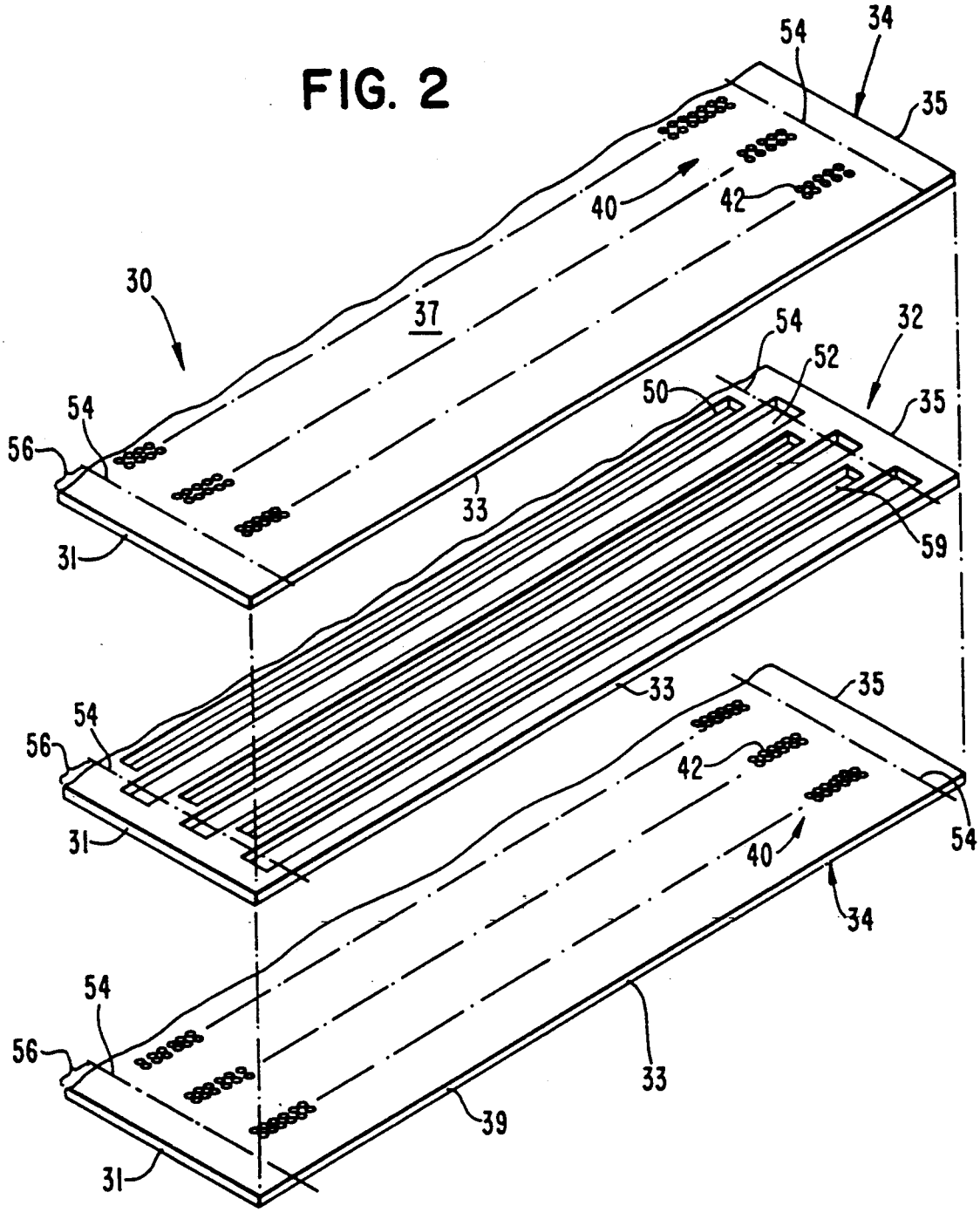
FIG. 2 illustrates a partial exploded assembly view of a heat exchanger in accordance with the invention prior to trimming of the sides.
Figure 3:
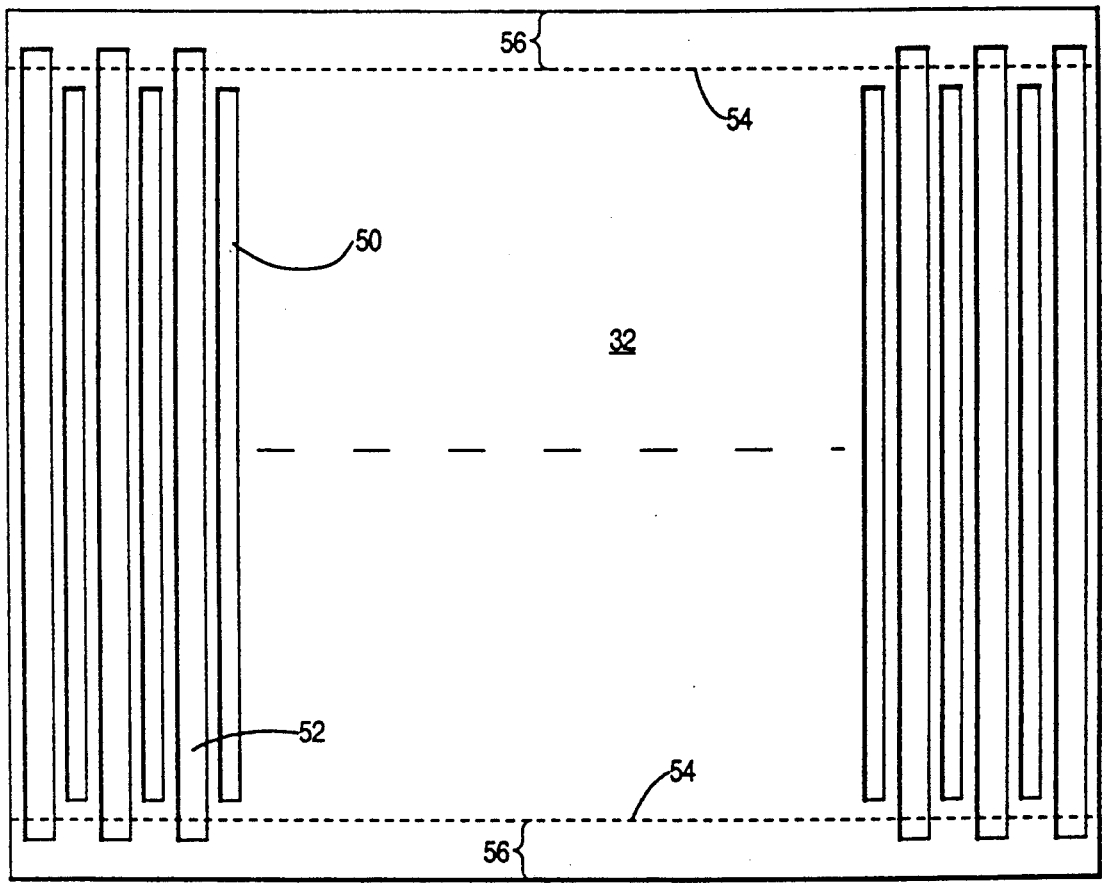
FIG. 3 is a plan view of a spacer plate illustrated in the exploded view of FIG. 2.
Figure 4:
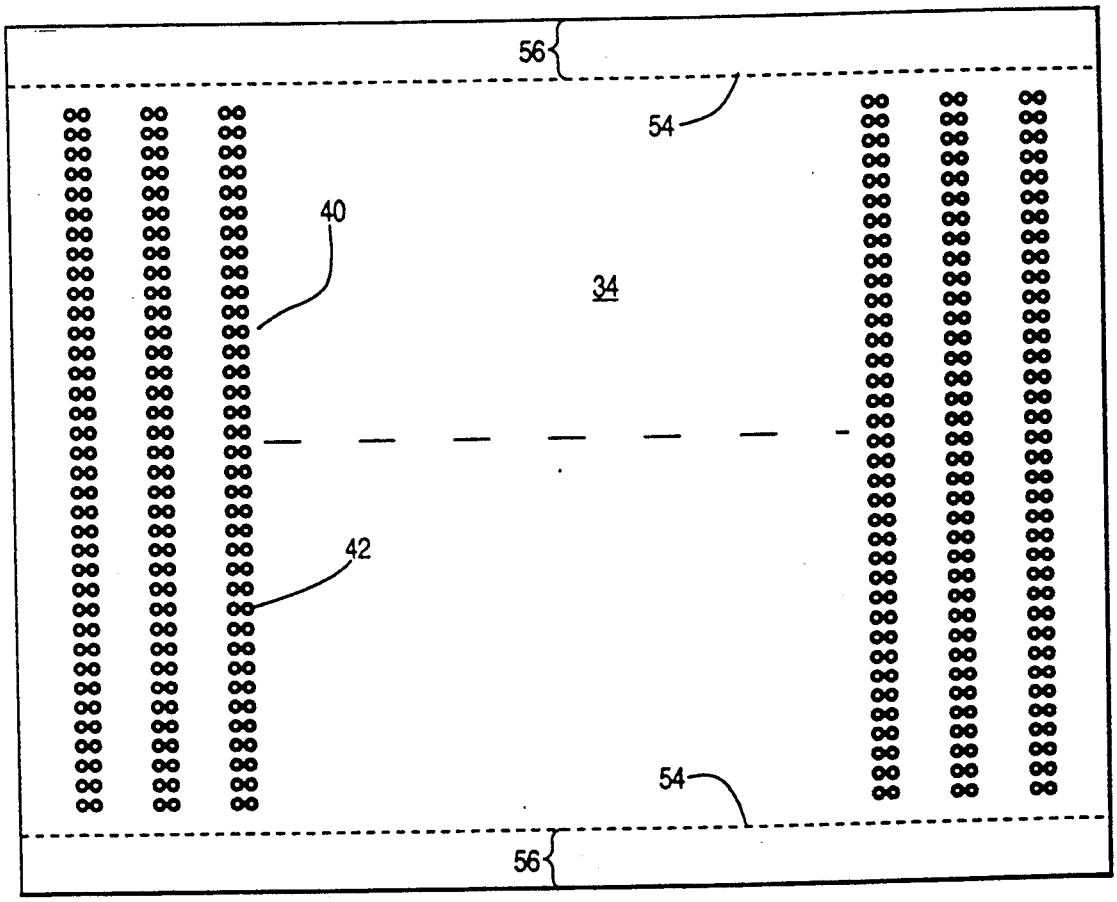
FIG. 4 is a plan view of an orifice plate illustrated in the exploded view of FIG. 2.

FIGS. 2–4 illustrate fabrication of a first embodiment of a heat exchanger core 30 for use with first and second fluids flowing transversely through the core in accordance with the present invention. FIG. 2 illustrates an exploded view of at least a part of a heat exchanger core 30 which is fabricated by attaching alternating spacer plates 32 and orifice plates 34 together with a fluid tight seal between plates to form a polyhedron preferably having opposed pairs of parallel surfaces with the details of the individual spacer plate 32 being illustrated in FIG. 3 and the details of the individual orifice plate 34 being illustrated in FIG. 4. In actual use, a typical heat exchanger core 30 would contain a larger number of plates than as illustrated in FIG. 2. It should be understood that headering for coupling the fluids to and from the heat exchanger core 30 have been omitted for purposes of clarity with any form of headering being useful in practicing the invention which forms inlet and outlet passages from the faces of the polyhedron of the heat exchanger core 30 to which the first and second fluids are coupled such as but not limited to headering described below in conjunction with FIG. 8.

With reference to FIG. 2, in accordance with an embodiment of the invention, a plurality of spacer and orifice plates 32 and 34, respectively, are stacked and attached together by any conventional process to form a fluid tight seal between opposed surfaces of the plates. The spacer and orifice plates 32 and 34 are aligned upon assembly so that a polyhedron with opposed flat surfaces is formed having four sides defined by peripheral edges 31, 33 and 35 and a fourth edge not illustrated and a top surface 37 and a bottom surface 39 respectively defined by a top surface of the top plate 34 in the stack and a bottom surface of the bottom plate 34 in the stack.

Each orifice plate 34 has at least one array of orifices 40 with individual orifices 42 passing through the thickness of the plate. Preferably, each orifice plate 34 has a plurality of parallel arrays of orifices 40 which extend across the plate toward peripheral sides 31 and 35 and not to trim line 54. The purpose of the trim line 54 is discussed below. Each array of orifices 40 is disposed in a channel in which jet impingement heat exchange occurs within the heat exchanger core 30 with one of the fluids as described below with reference to FIG. 5.

Each spacer plate 32 has at least one first slot 50 which extends through the plate and across the plate toward peripheral sides 31 and 35 and not to the trim line 54 and at least one second slot 52 which extends through and across the plate toward the peripheral sides and past the trim line. Each second slot 52, after trimming away section 56 as described below to form opposed surfaces at the trim line, functions as a channel for conducting the other of the fluids through the heat exchanger core 30. Each first slot 50 is aligned with one of the arrays of orifices 40 of adjacent orifice plates 34 and is disposed in a channel receiving the fluid flowing through the orifices 42 of the orifice plate 34.

In order to achieve maximum heat transfer between a fluid and the heat exchanger core 30, the orifices 42 of successive orifice plates 34 are staggered to cause impingement of jets of fluid produced by each orifice on a heat conductive surface of the subsequent orifice plate 34 located between orifices. After impingement of each jet on a surface of a subsequent orifice plate 34, the fluid migrates along the subsequent plate to an orifice in the plate through which the fluid passes. This process continues for each subsequent orifice plate in the polyhedron.

It should further be noted that the dimensions of the outside periphery of the plates 32 and 34 are preferably identical. The attachment together of the individual plates 32 and 34 preferably forms a plurality of pairs of flat parallel surfaces with first and second pairs of the flat parallel surfaces respectively forming the inlet and outlet for the first and second fluids flowing through the heat exchanger core 30.

The present invention provides a simple and economical manufacturing process for forming a heat exchanger core 30 for receiving first and second fluids flowing through channels within the heat exchanger core which do not intersect and which are transverse and preferably orthogonal to each other. The individual slots 50 and 52 and orifices 42 passing through the thickness of the plates 32 and 34 described above may be formed by conventional manufacturing processes such as but not limited to milling, stamping, punching or etching. Furthermore, the spacing between the individual fluid conducting channels for conducting each of the fluids and the dimensions of the channels may be varied by variation of the thickness of the individual plates 32 and 34 and the width and length of the slots 50 an 52. Furthermore, the dimensions of the channels may be further modified by varying alignment of slots between adjacent plates and providing slots in place of the arrays of orifices 40. Examples of modifications of the spacing and orifice plates 32 and 34 are discussed below with reference to FIGS. 6, 8 and 11–16 with it being understood that other modifications of the plates are also within the scope of the present invention. It should be understood that the number of faces of the heat exchanger core 30 and their orientation with respect to each other may be varied in accordance with the teachings of the invention. While preferred, it is not necessary that the fluid channels through the heat exchanger core 30 and opposed faces are parallel. Moreover, it should be understood that the alternative spacer and orifice plates may be used in place of or in conjunction with the spacer and orifice plates 32 and 34 illustrated in FIG. 2 with specific examples being illustrated in FIGS. 7 and 9 as discussed below.

Figure 1:
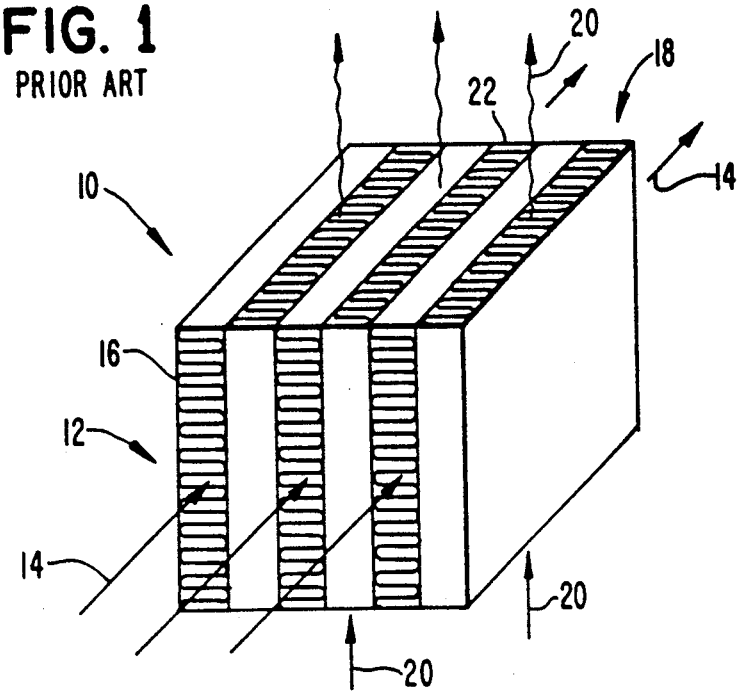
FIG. 1 PRIOR ART
FIG. 1 illustrates a prior art heat exchanger.
Figure 5:
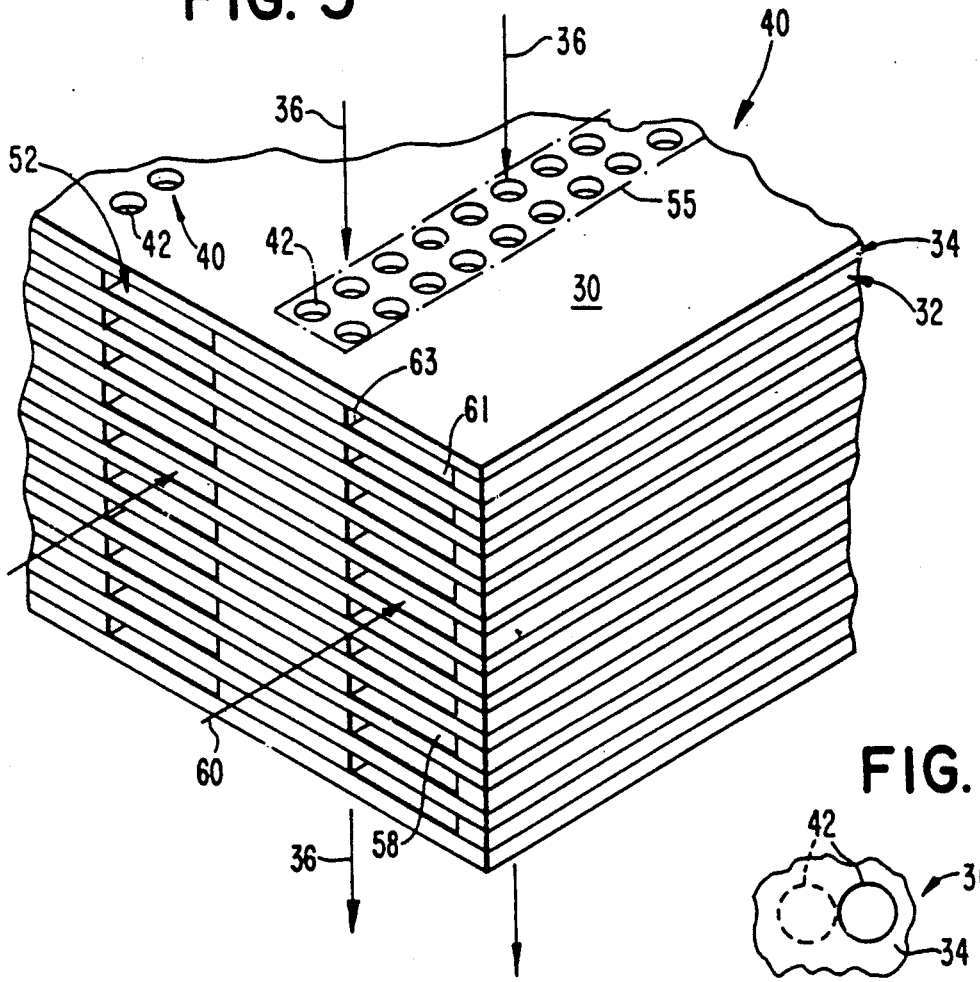
FIG. 5 is a fragmentary isometric view of a heat exchanger core in accordance with the present invention after sides of the faces of the heat exchanger core have been trimmed to form channels extending through the heat exchanger core.

FIG. 5 illustrates a partial isometric view of an assembled heat exchanger core 30 after the portion 56 of opposed faces outside the cutoff line 54 has been removed. A first fluid 36 flows from a header (not illustrated) through the orifices 42 of the arrays of orifices 40 and out from orifices to a header (not illustrated). The flow of the first fluid 36 is through at least one first channel 55 with each first channel being defined by the alternating arrays of orifices 40 and slots 50. For purposes of clarity, only part of a single first channel 55 has been illustrated with it being understood that the first channel passes down through the stacked spacer and orifice plates 32 and 34. At least one second channel 58 conducts a second fluid 60 which is applied to the heat exchanger core 30 by a header (not illustrated) which functions as an inlet to the heat exchanger core and which is discharged at an opposed parallel face (not illustrated) through a header (not illustrated) which functions as the outlet for the second fluid. It should be understood that headers for coupling the first and second fluids 36 and 60 to the inlets and the outlets of the heat exchanger core 30 have been omitted for purposes of clarity and may be any conventional structure. The heat exchanger core 30 of FIG. 5 is highly efficient in transferring heat between the core and the first fluid 36 as a consequence of the jet impingement cooling provided in channels 55 including the arrays of orifices 40. The high rate of transfer of heat between the first fluid 36 and the heat exchanger core 30 in the direction of flow of the first fluid 36 minimizes the dimension of the heat exchanger core in the direction of flow of the first fluid. Furthermore, as a consequence of the second channels 58 passing through the interior of the heat exchanger core 30 without substantial obstruction, the efficiency of heat transfer between the second fluid 60 and the heat exchanger core 30 is considerably less than the efficiency of transfer of heat between the first fluid 36 and the heat exchanger core. As a consequence of the lesser rate of heat exchange between the second fluid 60 and the heat exchanger core 30, the dimension of the heat exchanger core in the direction of flow of the second fluid 60 is elongated over that which would be required if a jet impingement cooling mechanism were provided in the second channel. Therefore, where spatial considerations of placement of the heat exchanger core 30 of the present invention are important, the channels 55 in which the first fluid 36 flows should be oriented in a direction where the heat exchanger core should have a minimal channel length dimension and the second channels 58 should be oriented in a direction where having the minimal channel length dimension is not critical. Furthermore, as a consequence of the first and second fluids 36 and 60 flowing in orthogonal directions through the center of the core, the heat exchanger core 30 eliminates the requirement for headers causing the first and second fluids to be directed through 90° turns when the first and second fluids are provided with orientations which are orthogonal to each other. The heat exchanger core of the above-referenced U.S. patent application Ser. No. 280,956, while being extremely efficient in transferring heat between the first and second fluids flowing in the same or opposite directions through channels of the heat exchanger core, is disadvantageous for applications where the sources of fluids are orthogonally oriented with respect to each other which necessitates the providing of headers which turn at least one of the fluids through 90° with a concomitant weight penalty which may more than eliminate the weight advantage of having jet impingement cooling in the channels for the first and second fluids.

Figure 5A:
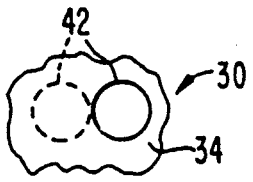
FIG. 5*a* illustrates the axial misalignment of orifices.

FIG. 5*a* illustrates the axial misalignment of orifices 42 between adjacent plates 34 to provide jet impingement cooling.

Figure 6:
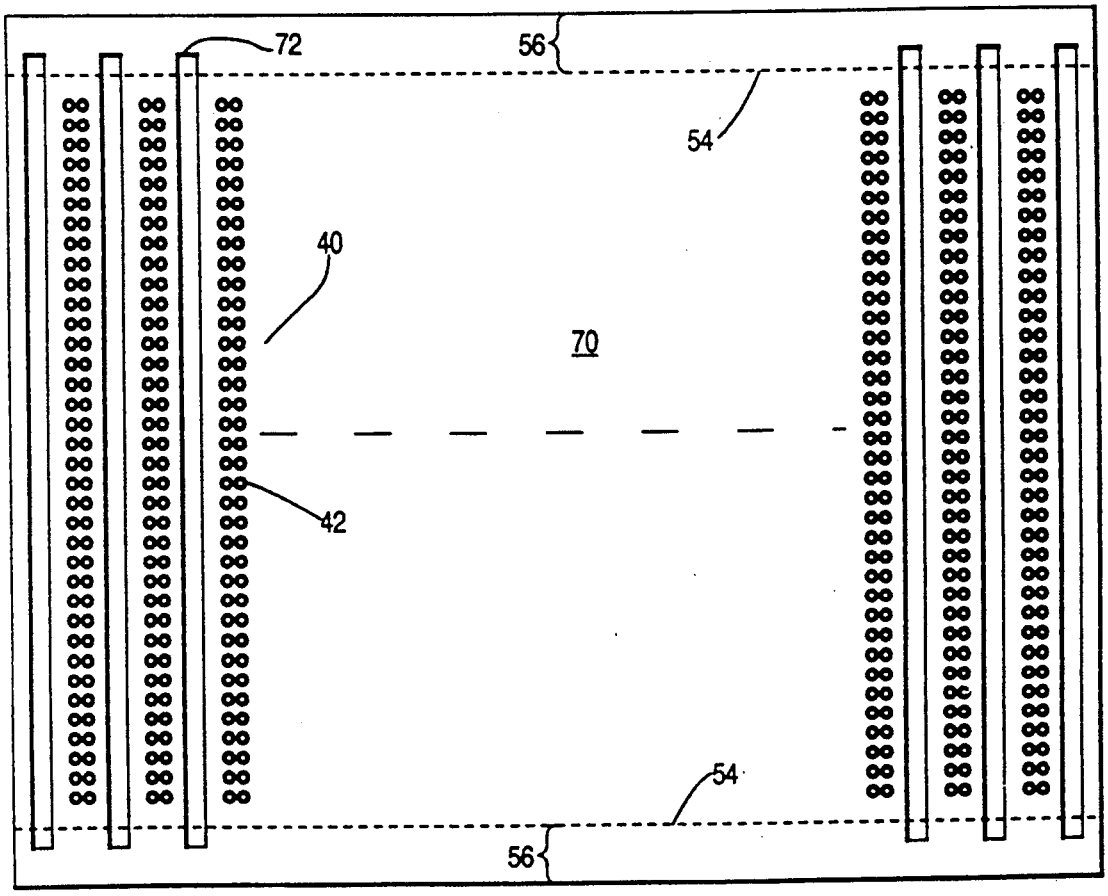
FIG. 6 is a plan view illustrating a modification of the orifice plate illustrated in FIG. 4.

FIG. 6 illustrates a plan view of a first alternative orifice plate 70 which may be used in conjunction with or in place of the orifice plate 32 discussed above. Like reference numerals identify like parts in FIGS. 4 and 6. The orifice plate 70 of FIG. 6 differs from that of FIG. 4 in that a plurality of parallel slots 72, extend through the plate 70 and across the plate toward peripheral sides to outside the cutoff line 54. The outside dimensions of the plate 70 are preferably identical to the dimensions of the plates of FIGS. 3 and 4. The slots 72 are in alignment with the corresponding slots 52 of the plate 34. Upon cut off of the portion 56 after the plates have been fabricated into the heat exchanger core 30 in the form of a polyhedron, the slots 72 form the second channels 58 in the same manner produced by the slots 52 of FIG. 3. The incorporation of the plates 70 in the heat exchanger core 30 in place of or in addition to the plate 32 of FIG. 4 causes the height of the individual channels 58 to be increased by the thickness of the plate 70. The parallel arrays of orifices 40 function in the same manner as the arrays of orifices in FIG. 4.

Figure 7:
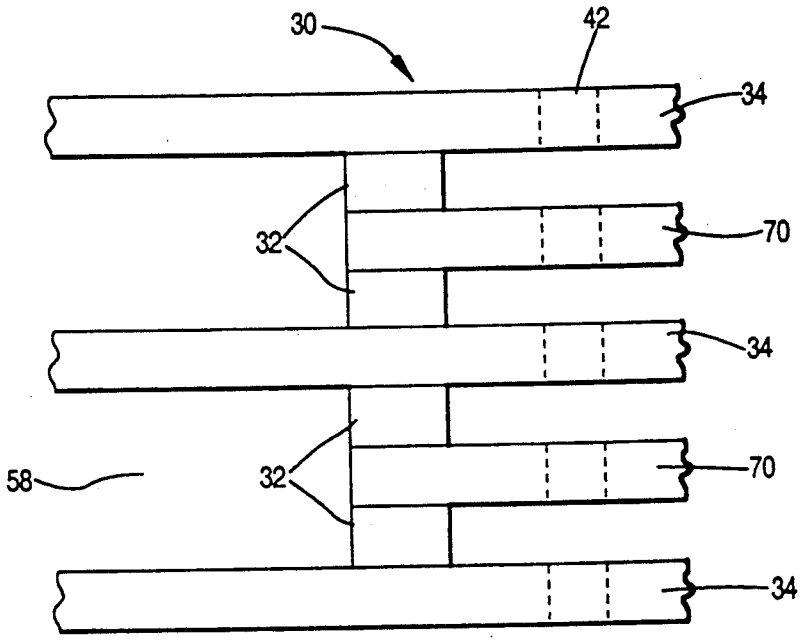
FIG. 7 is a partial side elevational view illustrating an example of a heat exchanger core containing the plates of FIGS. 3, 4 and 6.

FIG. 7 illustrates a partial side elevational view of an example of a heat exchanger core 30 containing the plates of FIGS. 3, 4 and 6 discussed above. Like reference numerals identify like parts in FIGS. 3, 4, 6 and 7. As illustrated, the height of the channels 58 is increased by the spacing of the orifice plate 70 between adjacent spacer plates 32. It should be understood that other permutations of the plates may be utilized in practicing the invention.

Figure 8:
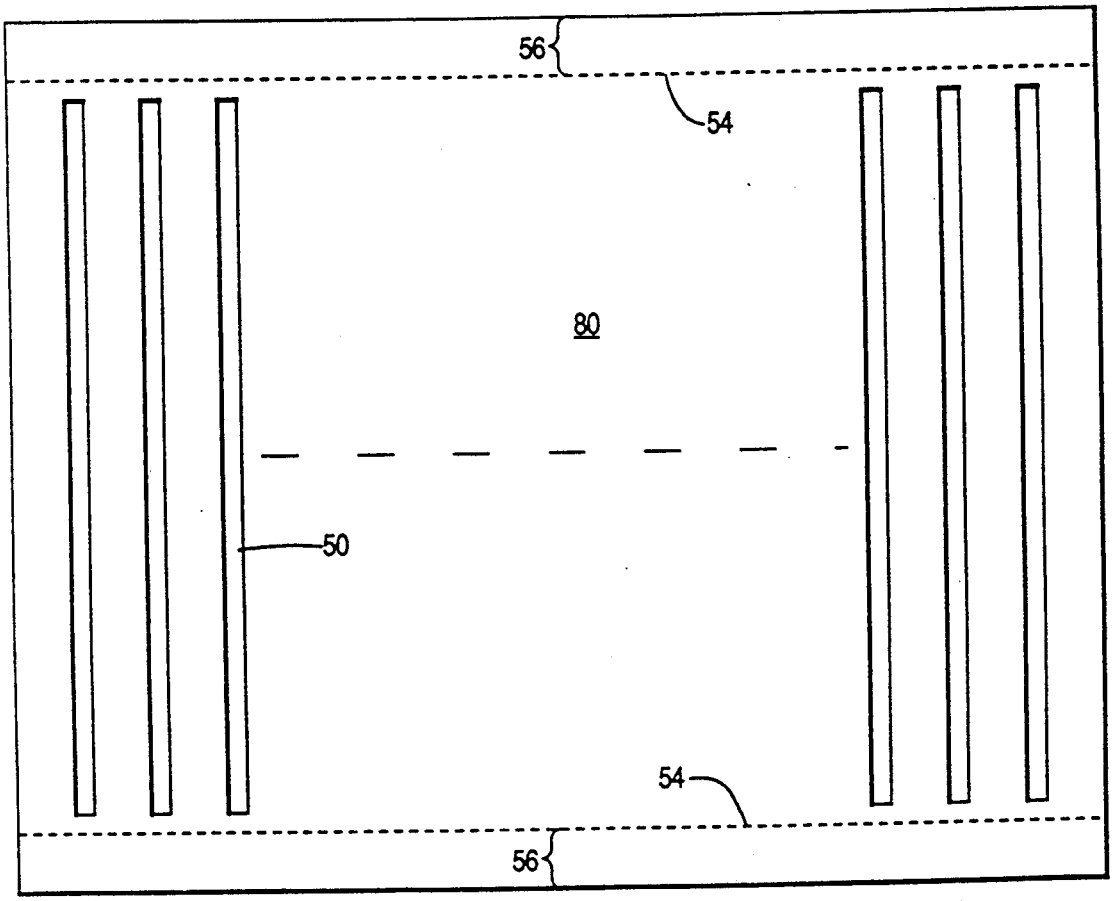
FIG. 8 is a plan view illustrating a modification of the spacer plate illustrated in FIG. 3.

FIG. 8 illustrates a plan view of a first alternative spacer plate 80 which may be used in conjunction with or in place of the spacer plate 32 of FIG. 3. FIG. 8 differs from FIG. 3 in that the slots 52 have been eliminated. Elimination of the slots 52 results in the second channels 58 being eliminated from the heat exchanger core 30 at locations in the heat exchanger core 30 where the plate 80 is located. Usage of the plate 80 permits the channels 58 to be modified for purposes of controlling the rate of heat exchange between the second fluid 60 and the second channels 58.

Figure 9:
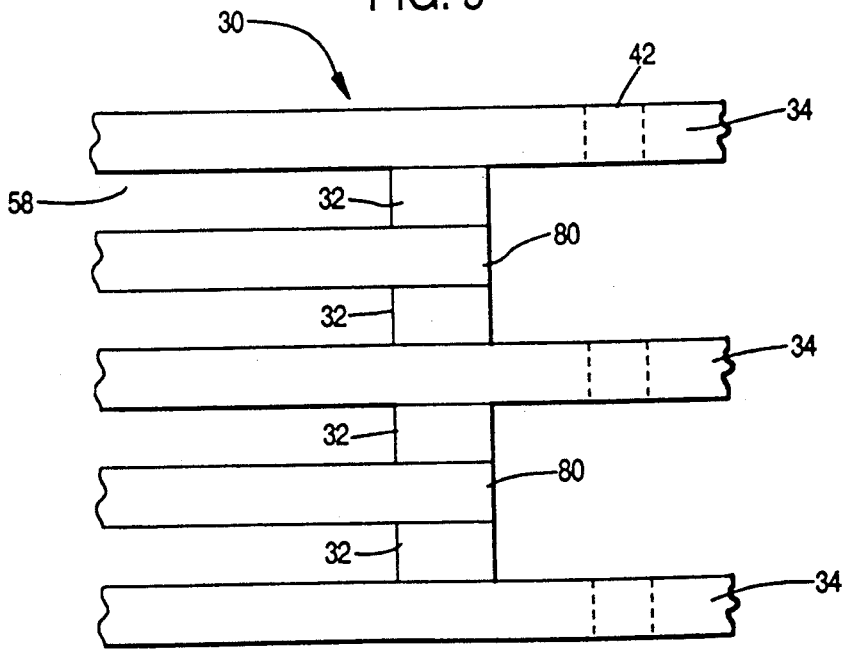
FIG. 9 is a partial side elevational view illustrating an example of a heat exchanger core containing the plates of FIGS. 3, 4 and 8.

FIG. 9 illustrates a partial side elevational view of a heat exchanger core 30 containing the plates of FIGS. 3, 4 and 8. Like reference numerals identify like parts in FIGS. 3, 4, 8 and 9. As illustrated in each place where the modified spacer plate 80 is placed in the core, no corresponding channels 58 are found. As a result, the space between adjacent orifice plates 34 is increased by the thickness of the modified spacer plate 80. It should be understood that other permutations of the plates may be utilized in practicing the invention.

Figure 10:
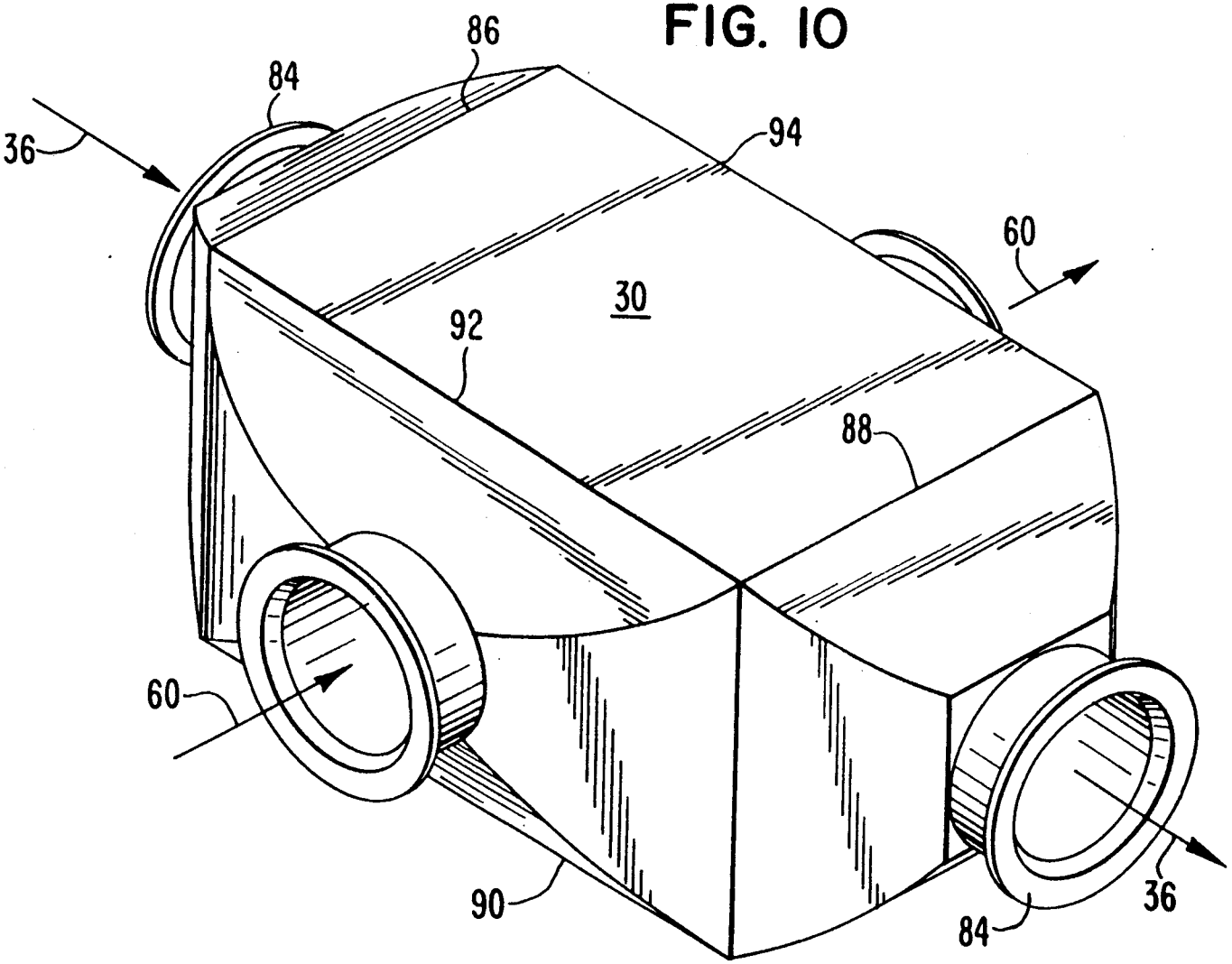
FIG. 10 illustrates a heat exchanger core in accordance with the present invention with an example of headering for the first and second fluids attached to opposed faces of the core.

FIG. 10 illustrates an example of headers which may be attached to the exposed faces of the heat exchanger core 30 of the present invention to form inlets and outlets for the first and second fluids 36 and 60. As illustrated, first and second headers 84 are attached to opposed parallel surfaces 86 and 88 of the heat exchanger core to respectively form an inlet and an outlet for the first fluid 36. Similarly, a pair of headers 90 are attached to opposed parallel surfaces 92 and 94 of the heat exchanger core 30 to form an inlet and an outlet respectively for the second fluid 60. It should be understood that the design of the headers 84 and 90 may be in accordance with any design for performing the function of coupling a fluid supply to a first exterior surface of the heat exchanger core to couple the fluid to the interior of the heat exchanger core where heat exchange between the fluid and the conductive surfaces of the core occur and for collecting the fluid discharged from a second exterior surface of the heat exchanger core which is opposed to the surface which receives the fluid to couple the fluid to an output.

Figure 11:
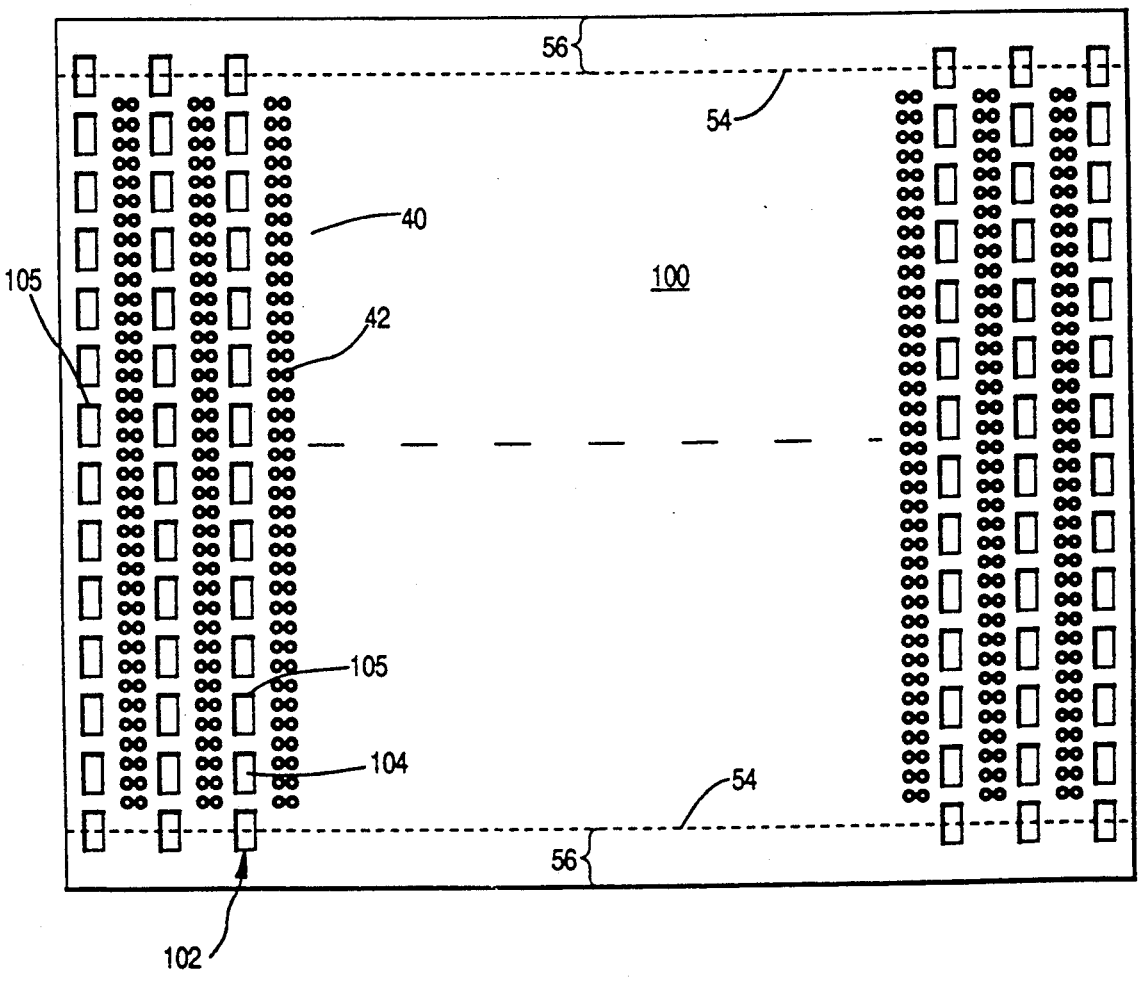
FIG. 11 is a plan view of a second modification of the orifice plate illustrated in FIG. 4.

FIG. 11 illustrates a plan view of a second alternative orifice plate 100 which may be used in conjunction with or in place of the orifice plate 32 of FIG. 4. Like reference numerals identify like parts in FIGS. 4 and 11 The plurality of arrays 102 of rectangular openings 104 passing through the plate are disposed between alternating arrays 40 of orifices 42 and are each aligned with a different slot 52. Each edge 105 contacting the fluid 60 during flow through a channel 58 creates a new boundary layer which enhances the rate of heat transfer between the walls of the channels 58. The exterior dimensions of the plate 100 are preferably identical to plate 32 of FIG. 4 so that placement of the plate 100 in the heater core 30 in accordance with FIG. 2 will produce the opposed parallel surfaces of a polyhedron.

Figure 12:
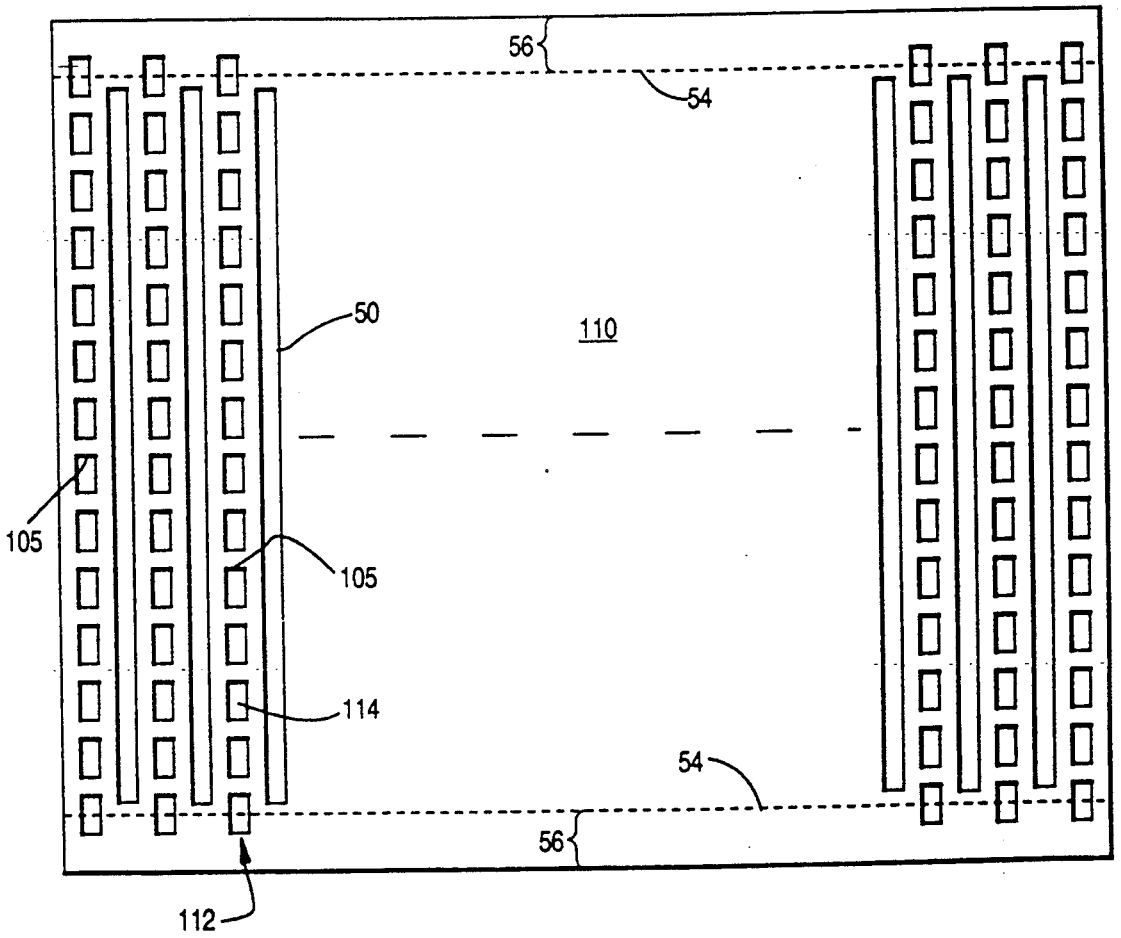
FIG. 12 is a plan view of a second modification of the spacer plate illustrated in FIG. 3.

FIG. 12 illustrates a plan view of second alternative spacer plate 110 which may be used in conjunction with or in place of the spacer plate 32 of FIG. 3. Like reference numerals identify like parts in FIGS. 3 and 12. It should be understood that the outside dimensions of the spacer plate 110 are preferably identical to the dimensions of the spacer plate of FIG. 3. A plurality of parallel arrays 112, each containing a plurality of rectangular openings 114 passing through the plate, are disposed in the positions corresponding to the slots 52 of FIG. 3. Each edge 105 functions in the same manner as the edges described above in conjunction with FIG. 11. The plate 110 is used in the heat exchanger core 30 such that it is placed adjacent to a plate 34 as illustrated in FIG. 3 to cause the edge 105 of each rectangular opening 114 to create a new boundary layer to enhance the rate of heat exchange between the fluid flowing in the channels 58.

Figure 13:
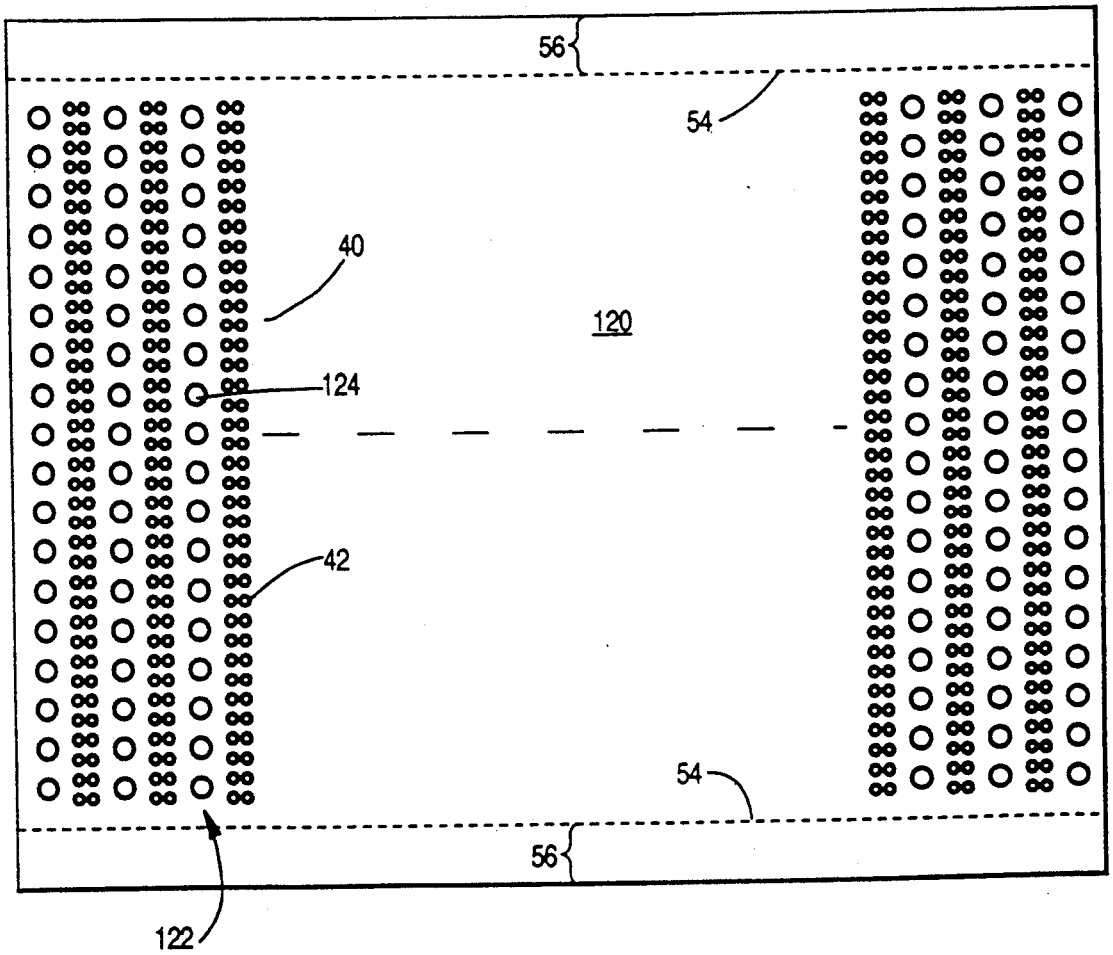
FIG. 13 is a plan view of a third modification of the orifice plate illustrated in FIG. 4.

FIG. 13 illustrates a plan view of a third alternative orifice plate 120 which may be used in conjunction with or in place of the orifice plate of FIG. 4. Like reference numerals identify like parts in FIGS. 4 and 13. The outside dimensions of the orifice plate 120 of FIG. 13 are preferably identical to the outside dimensions of the orifice plate 34 of FIG. 4 to cause opposed flat parallel surfaces of the heat exchanger core 30 to be formed when the spacer plate 32 and the orifice plate 120 are formed into the heat exchanger core 30 in accordance with FIG. 2. A plurality of parallel arrays 122 of perforations 124 are provided at positions on the plate corresponding to the positions of the slots 52 of FIG. 3. Each of the perforations 124 extends through the plate. The function of the perforations is to increase turbulence of the second fluid 60 during flow through the second channels 58. When the second fluid flows past an individual perforation 124 in a direction generally orthogonal to the opening of the perforation, a shear is created which increases turbulence which increases the rate of heat exchange between the second fluid and the walls of the second channels 58.

Figure 14:
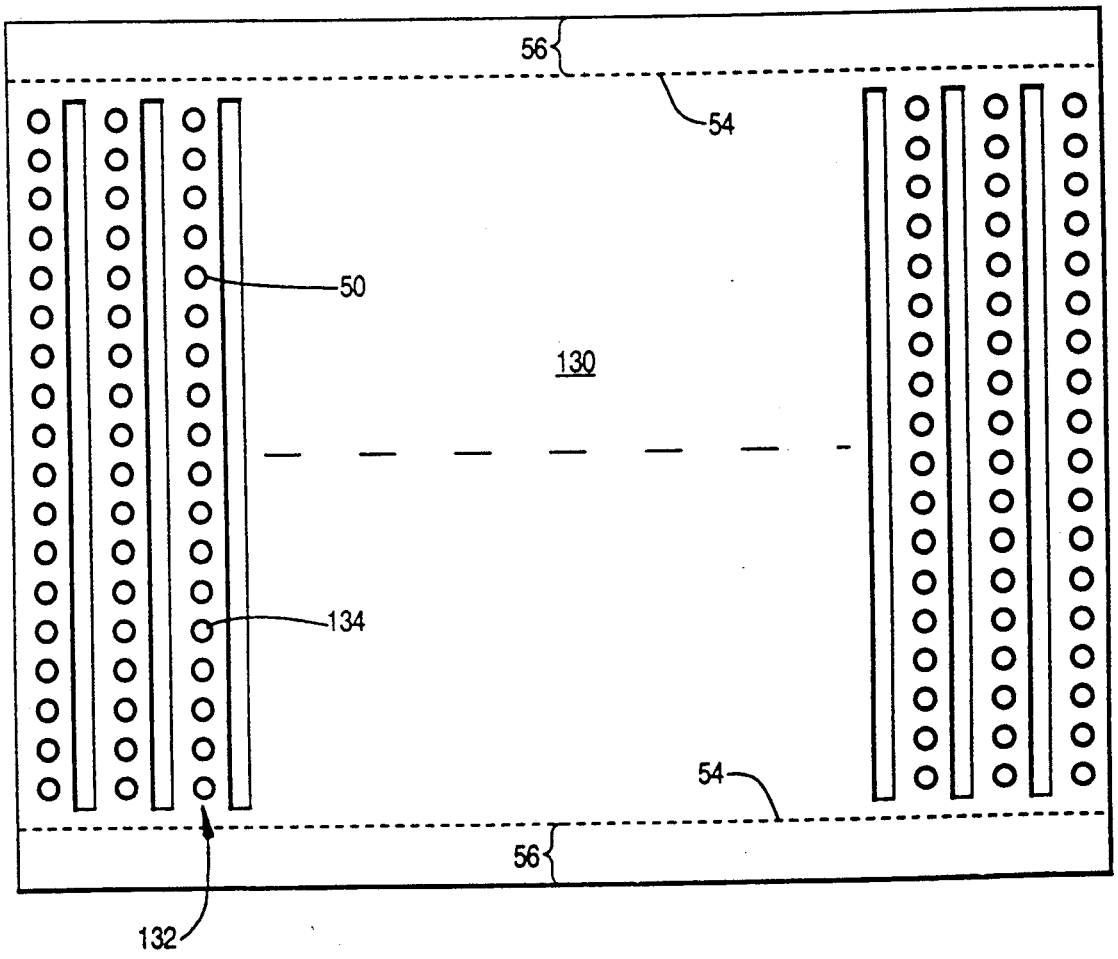
FIG. 14 is a plan view of a third modification of the spacer plate illustrated in FIG. 3.

FIG. 14 illustrates a plan view of a third alternative spacer plate 130 which may be used in place of or in conjunction with the spacer plate 32 of FIG. 3. Like reference numerals identify like parts in FIGS. 3 and 14. The outside dimensions of the spacer plate 130 are preferably identical to the spacer plate 32 of FIG. 3 so that opposed flat parallel surfaces of the heat exchanger core 30 are formed upon attachment of the spacer plates 130 and orifice plates 34 together in the form of a heat exchanger core 30. A plurality of parallel arrays 132 of perforations 134, which extend through the plate, are provided at positions corresponding to the slots 52 of FIG. 3. The plates 130 are used to form a heat exchanger core 30 by placement adjacent to at least one plate 32 as illustrated in FIG. 3. As a result, flow of the second fluid 60 through the channels 58 formed by the slots 52 of the adjacent spacer plate 32 is caused to shear when flowing past the individual perforations 34 in the manner discussed above with respect to the arrays of perforations 122 of FIG. 13.

A heat exchanger core 30 in accordance with the present invention has particular utility in applications requiring condensing or evaporating of one of the two fluids flowing through the heat exchanger core. The channels 58 may function to condense or evaporate one of the fluids flowing through the heat exchanger core. FIG. 17, discussed below, illustrates a sectional view through a spacer plate 140 of the heat exchanger core 30 in which the present invention is used for evaporating or condensing fluid. Prior to discussion of FIG. 17 a modified spacer plate as illustrated in FIG. 15 is discussed and a modified orifice plate as illustrated in FIG. 16 is discussed which are preferably utilized when the heat exchanger core, as illustrated in FIG. 17, is utilized for evaporating or condensing a fluid.

Figure 15:
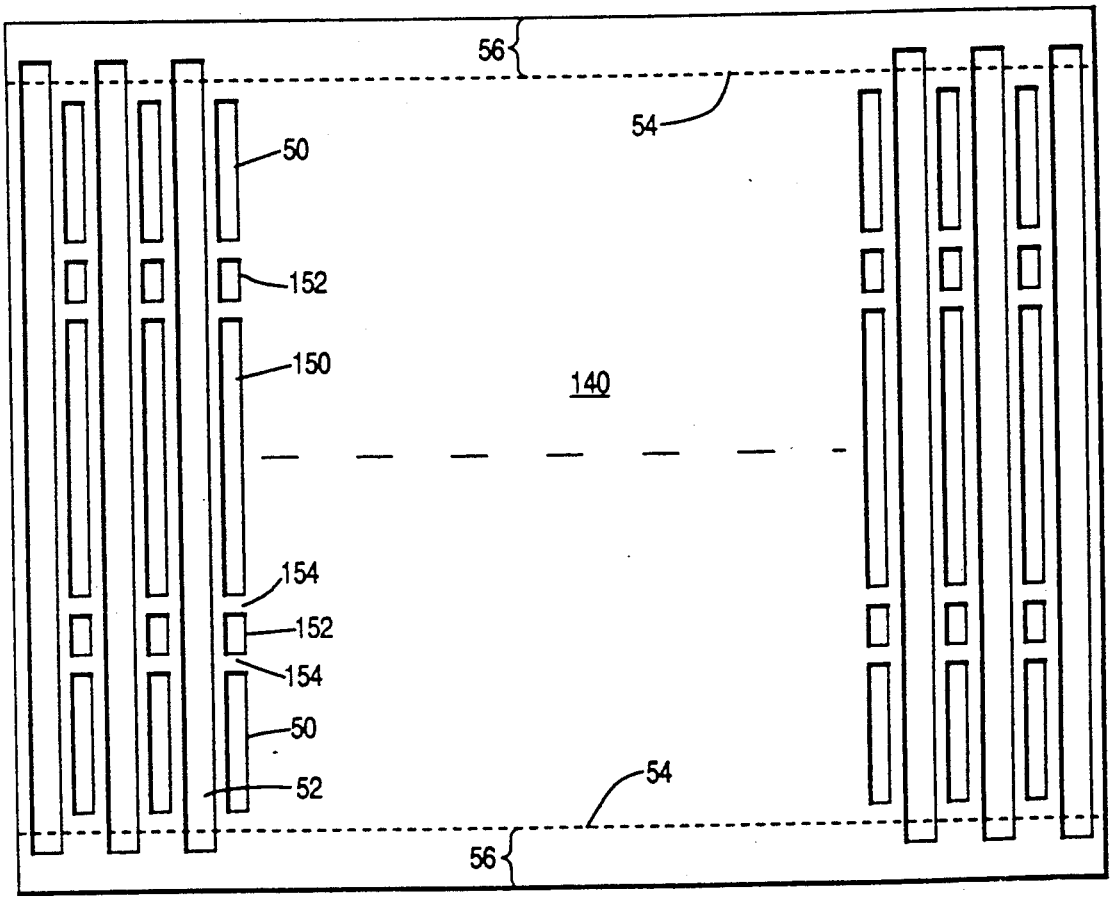
FIG. 15 is a plan view of a modification of the spacer plate of FIG. 3 for use in cores for condensing or evaporating fluids.

FIG. 15 illustrates a modification of a spacer plate 140 which is preferably utilized when the heat exchanger core 30 is utilized for evaporating or condensing a fluid flowing in channels 58. Like reference numerals identify like parts in FIGS. 3 and 15. The only difference between the spacer plate illustrated in FIG. 3 and in FIG. 15 is that a plurality of rectangular openings 152 are provided in each of the slots 50 to divide each slot into subparts. The rectangular openings 152 in each of the slots 150 provide a high resistance to heat flow between fluids flowing in adjacent channels 55 of the heat exchanger core 30 as illustrated in FIG. 17. Fluid flow in the subparts on either side of the rectangular openings 152 is in the opposite directions. A solid heat conductive section 154 is disposed on each side of opposed faces of the rectangular openings 152 to prevent cross coupling of fluid in the adjacent subparts on either side of each rectangular opening 152. When configured in heat exchanger core 30, the spacer plate 140 does not have any fluid flowing through the channel defined by the rectangular openings 152 which provides thermal isolation between fluids flowing in adjacent subparts.

Figure 16:
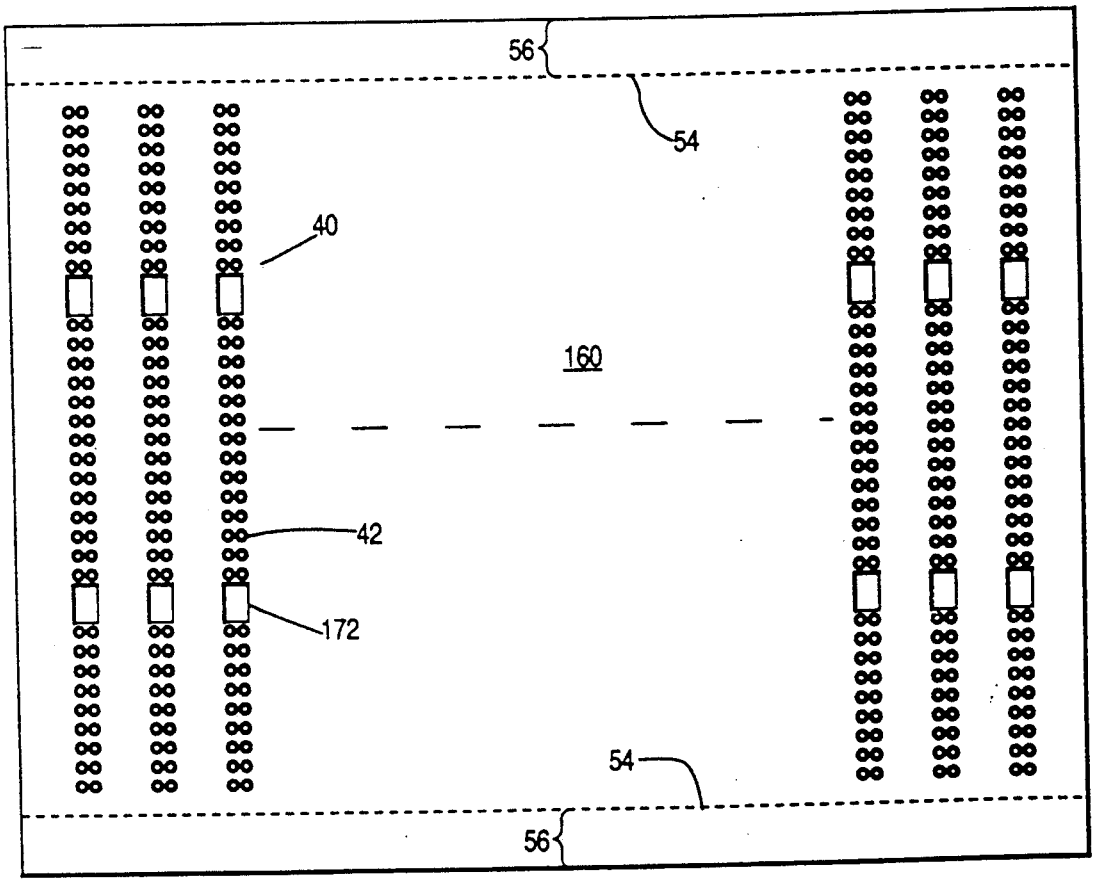
FIG. 16 is a plan view of a modification of the orifice plate of FIG. 4 for use in cores for condensing or evaporating fluids.
Figure 17:
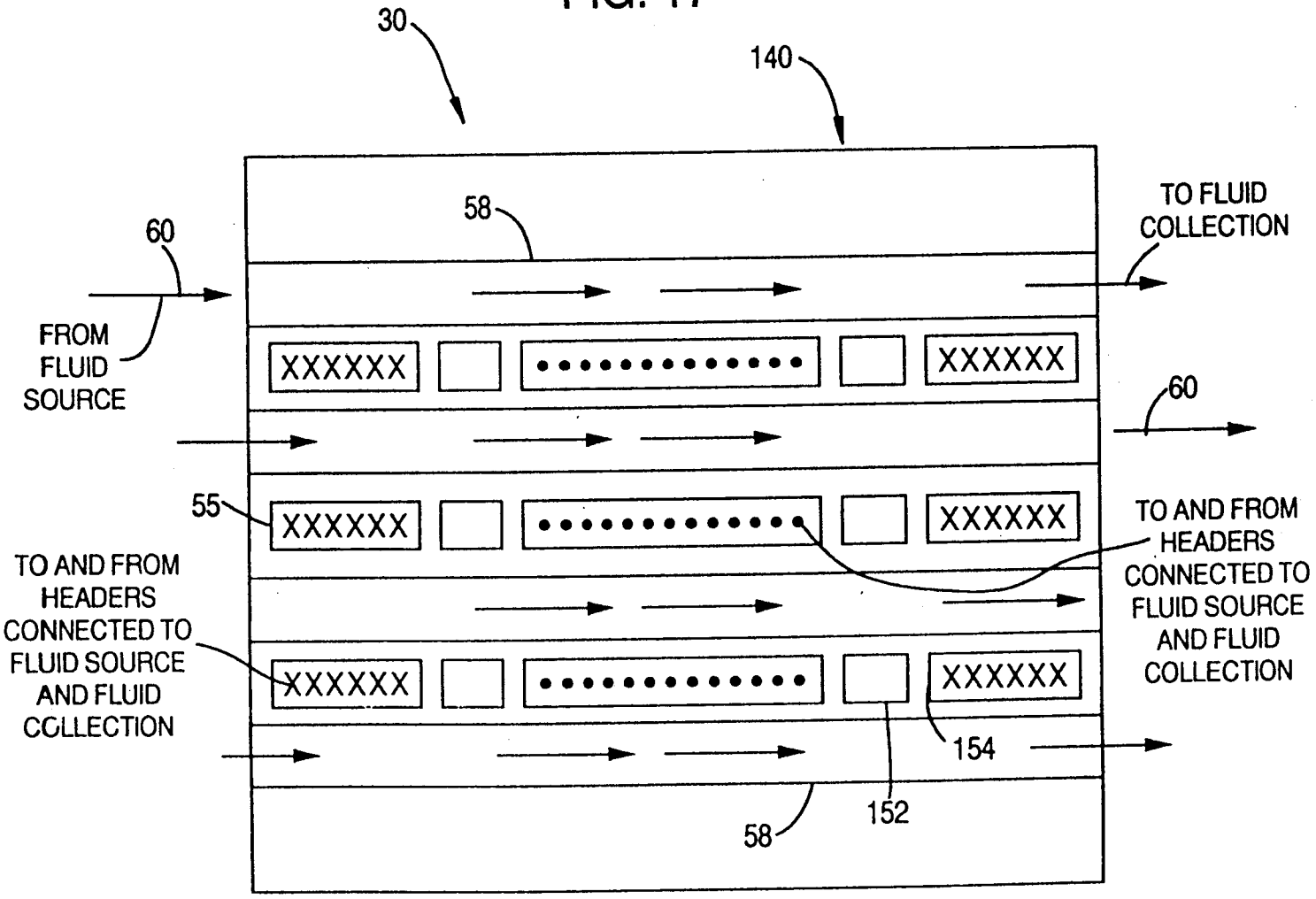
FIG. 17 is a sectional view of a spacer plate in a heat exchanger core used for condensing or evaporating fluids.

FIG. 16 illustrates a modification of an orifice plate 160 which is preferably utilized when the heat exchanger core of FIG. 17 is utilized for evaporating or condensing a fluid flowing in the channels 58. Like reference numerals identify like parts in FIGS. 4 and 16. A plurality of rectangular openings 172 are disposed within the arrays of orifices 42 at locations corresponding to the locations of the rectangular openings 152 discussed above with reference to FIG. 15 which divide the arrays of orifices into subparts. Fluid flow in the subparts of the array of orifices 140 on either side of a rectangular opening 172 is in the opposite direction. Without the openings 152 and 172 discussed above with reference to FIGS. 15 and 16, flow of fluids in the opposite directions on each side of a rectangular opening would not be possible. Fluid flow in one direction would lessen the efficiency of the heat exchanger core 30 in evaporating or condensing a fluid.

FIG. 17 illustrates a sectional view through an orifice plate 140 as illustrated in FIG. 15 in a heat exchanger core 30 for condensing or evaporating a fluid. Like reference numerals identify like parts in FIGS. 15 and 17. The heat exchanger core 30 is fabricated with a series of stacked plates such as, but not limited to, the example of FIG. 5. It should be understood that the scale of the channels 55 and 58 has been changed for purposes of illustration. A header, which may be any conventional design, schematically illustrated by arrow 60 provides fluid from a fluid source (not illustrated) to one of the faces of the heat exchanger core 30. The fluid source may be any conventional fluid source of a fluid to be condensed or evaporated. Similarly, a header, which may be any conventional design, schematically illustrated by the arrows leaving the heat exchanger core 30, that are identified by "to fluid collection", collects fluid discharged from heat exchanger core 30 and couples it to a suitable collection. Fluid flows through the interior section of the heat exchanger core 30 in the channels 58 in one direction. Preferably, while not limited thereto, fluid flow in adjacent subparts of a channel 55 or between corresponding subparts in adjacent channels 55 is in opposite directions. An "X" indicates fluid flow in a first direction within the exchanger core 30 and a "·" indicates fluid flow in a second opposite direction within the heat exchanger core. Heading is used for the channels 55 to provide fluid from a fluid source to both opposed faces of the heat exchanger core which are parallel to the plane of FIG. 17 and to collect the fluid discharged from both of the identical opposed faces of the heat exchanger core which are parallel to the plane of FIG. 17.

With reference to FIG. 17, each subpart of a channel 55 having "X" fluid flow represents fluid flow from a fluid source to a header connected to a first face of the heat exchanger core 30 to a header collecting fluid connected to a second face of the heat exchanger core opposed to the first face. Each subpart of a channel 55 having "·" fluid flow represents fluid flow from the fluid source to a header connected to the second face of the heat exchanger core 30 to a header collecting fluid connected to the first face.

The net cross-section area of all of the subparts of channels 55 having fluid "X" flowing in a first direction is desirably substantially equal to the net cross-sectional area of the subparts of channels 55 having fluid "·" flowing in the second direction throughout the dimension of the heat exchanger core 30 parallel to the channels 55. This relationship insures that the flow of the first fluid is substantially equal in the "X" and "·" directions to balance the transfer of heat to or from the first fluid in both the "X" and "·" fluid flow directions.

If fluid to be condensed or evaporated were to be applied to a single face of the heat exchanger core, the overall efficiency of the heat exchanger core would be lessened as a consequence of the rapid drop or rise in temperature of fluid flowing through the channels 58. This would lessen the transfer of heat to the second fluid in the portion of the channels 55 near the point of discharge from the heat exchanger core 30. The coupling of the fluid 60 to opposed faces of the heat exchanger core 30 enhances the efficiency of transfer of heat energy to the fluid flowing in the second channel 55 throughout the entire heat exchanger core 30. Accordingly, providing of the fluid to the heat exchanger core to be condensed or evaporated to opposed surfaces of the heat exchanger core enhances the overall efficiency of transferring of heat to or from the second fluid flowing orthogonal to the fluid being condensed or evaporated throughout the entire volume of the heat exchanger core.

With respect to FIGS. 2 and 5, the manufacturing process of the present invention for manufacturing a heat exchanger core 30 for transferring heat between first and second fluids flowing transversely with respect to each other through the heat exchanger core is explained as follows. The heat exchanger core 30 is a polyhedron having a plurality of faces which contain the heat exchanger core, a first pair of faces respectively being an inlet and an outlet for the first fluid 36 and a second different pair of faces respectively being an inlet and an outlet for the second fluid 60, at least one first channel 55 defined by arrays 40 and corresponding slots 52 extending through an interior section of the heat exchanger core between the first pair of faces for permitting the first fluid to flow between the first pair of faces with each first channel having a plurality of walls, which in the orifice plates are the cylindrical surfaces of the individual perforations 42, material connecting the perforations on the top and bottom surfaces of the orifice plates and in which the spacer plates are the sides 59 illustrated in FIG. 5 peripherally defining each slot 50, for permitting heat exchange between the walls of each first channel and the first fluid and at least one second channel 58 extending through the interior section of the heat exchanger between the second pair of faces for permitting the second fluid to flow between the second pair of faces with each second channel having a plurality of heat conductive walls for permitting heat exchange between the walls of each second channel and the second fluid, and each second channel being thermally coupled to each first channel and offset from each first channel. The manufacturing process comprises the following steps. A plurality of spacer plates, which may be any of the spacer plates 32, 80, 110, 130 or 140 respectively described above with reference to FIGS. 3, 7, 8, 12, 14 and 15 or combinations thereof, are provided. Furthermore, a plurality of second plates, which may be the orifice plates 34, 70, 100, 120, or 160 respectively described above with reference to FIGS. 4, 6, 11, 13 and 16 or combinations thereof, are provided. Combinations of the aforementioned plates are stacked and attached together with a fluid tight seal to form the first pair of faces of the polyhedron as illustrated in FIG. 2. The combinations of the stacked plates may be varied. Thereafter, the portion 56 of opposed peripheral sides of the first and second plates is cut along cutting lines 54 on the opposed peripheral sides to remove the portion 56 to expose the second channels 58 to form the sides illustrated in FIG. 5 having openings to the channels 58. The aforementioned manufacturing process may be utilized to form heat exchanger cores for exchanging heat between first and second fluids which are flowing transversely through the core and preferably orthogonally with the aforementioned process. It should be further understood that the process is not limited to the particular spacer plates and orifice plates described above with it also being useful for forming first and second channels using only the spacer plates 32, 80, 110, 130, or 140 as described above.

While the invention has been described in terms of its preferred embodiment, it should be understood that numerous modifications may be made thereto without departing from the spirit and scope of the invention as defined in the appended claims. For example, while preferably the individual walls of the channels 55 and 58 are parallel to each other, the height and/or width of the channels may be tapered. It is intended that all such modifications fall within the scope of the appended claims.

What is claimed is:

1. A heat exchanger for transferring heat between first and second fluids flowing transversely with respect to each other through a heat exchanger core comprising:

a polyhedron having a plurality of faces which define the heat exchanger core, a first pair of faces respectively being an inlet and an outlet for the first fluid and a second different pair of faces respectively being an inlet and an outlet for the second fluid;

at least one first channel extending through an interior section of the heat exchanger core between the first pair of faces for permitting the first fluid to flow between the first pair of faces with each first channel having a plurality of heat conductive walls for permitting heat exchange between the walls of each first channel and the first fluid;

at least one second channel extending through the interior section of the heat exchanger core between the second pair of faces for permitting the second fluid to flow between the second pair of faces with each second channel having a plurality of heat conductive walls for permitting heat exchange between the walls of each second channel and the second fluid, each second channel being thermally coupled to each first channel and offset from each first channel, each second channel having at least one jet impingement cooling means having at least one fluid orifice disposed within the second channel for forming a jet of the second fluid as fluid passes through the at least one second channel which impinges upon a heat conductive surface within the second channel;

a stack of a plurality of heat conductive first and second plates with at least one first plate partially defining at least one first channel and at least two second plates each having at least one fluid orifice within each second channel; and wherein each first plate comprises first and second slots which each extend through the first plate to form a passage, each first slot extending across the first plate to opposed peripheral sides of the first plate and each second slot extending across the first plate and not to the opposed peripheral sides, each first slot being contained in a different first channel with the opposed peripheral sides respectively being disposed on different faces of the first pair of faces and each second slot being disposed within a different second channel.

2. A heat exchanger in accordance with claim 1 wherein:

adjacent pairs of the second plates face at least one first plate to form the at least one first channel; and at least one second plate has at least one array of orifices, each array of orifices passing through the second plate and not extending to opposed peripheral sides of the second plate with each array of orifices being aligned in fluid communication with the second slot of an adjacent first plate.

3. A heat exchanger in accordance with claim 2 wherein:

the orifices of the at least one array of orifices of adjacent second plates are not axially aligned.

4. A heat exchanger in accordance with claim 3 wherein at least one second plate further comprises:

at least one array containing at least one opening passing through the second plate disposed between adjacent arrays of orifices, each opening forming a new boundary layer to enhance heat exchange between the first fluid and the first channel; and each array of at least one opening is aligned with a different first channel.

5. A heat exchanger in accordance with claim 3 wherein:

at least one second plate further comprises at least one array of perforations, disposed between adjacent arrays of orifices, each array of perforations having at least one perforation passing through the second plate and not extending to opposed peripheral sides of the second plate containing the array of orifices.

6. A heat exchanger in accordance with claim 2 wherein:

at least one first plate contains a number of slots equal to the number of first channels in the heat exchanger core, each slot extending across the first plate to opposed peripheral sides of the plate, each slot being contained in a different first channel with the opposed peripheral sides of the first plate respectively disposed on different faces of the first pairs of faces.

7. A heat exchanger in accordance with claim 2 wherein:

at least one second plate has at least one slot extending across the second plate to opposed peripheral sides of the second plate, the opposed peripheral sides of the second plate being respectively disposed in different faces of the second pair of faces and each slot of the second plate is contained in one first channel.

8. A heat exchanger in accordance with claim 2 wherein:

the heat exchanger core has a plurality of first plates; and at least one first plate comprises a plurality of slots extending through and across the first plate and not to opposed peripheral sides of the first plate, each slot being contained in a different second channel and at least one array containing at least one opening passing through the first plate disposed between adjacent slots, each opening forming a new boundary layer to enhance heat exchange between the second fluid and the second channel and each array of the at least one opening is contained within a different first channel.

9. A heat exchanger in accordance with claim 2 wherein:

at least one second plate comprises at least one array of perforations, disposed between adjacent arrays of orifices, each array of perforations having at least one perforation passing through the second plate and not extending to opposed sides of the second plate containing the at least one array of perforations.

10. A heat exchanger in accordance with claim 1 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

11. A heat exchanger in accordance with claim 2 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

12. A heat exchanger in accordance with claim 3 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

13. A heat exchanger in accordance with claim 2 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

14. A heat exchanger in accordance with claim 3 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

15. A heat exchanger in accordance with claim 4 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

16. A heat exchanger in accordance with claim 5 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

17. A heat exchanger in accordance with claim 6 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

18. A heat exchanger in accordance with claim 7 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

19. A heat exchanger in accordance with claim 8 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

20. A heat exchanger in accordance with claim 9 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

21. A heat exchanger for transferring heat between first and second fluids flowing transversely with respect to each other through a heat exchanger core comprising:

a polyhedron having a plurality of faces which form the heat exchanger core, a first pair of faces respectively being an inlet and an outlet for the first fluid and a second different pair of faces respectively being an inlet and an outlet for the second fluid;

at least one first channel extending through an interior section of the heat exchanger core between the first pair of faces for permitting the first fluid to flow between the first pair of faces with each first channel having a plurality of heat conductive walls for permitting heat exchange between the walls of each first channel and the first fluid;

at least one second channel extending through the interior section of the heat exchanger core between the second pair of faces for permitting the second fluid to flow between the second pair of faces with each second channel having a plurality of heat conductive walls for permitting heat exchange between the walls of each second channel and the second fluid, each second channel being thermally coupled to each first channel and offset from each first channel;

a stack of a plurality of heat conductive first and second plates with at least one first plate partially defining at least one first channel and at least one second plate at least partially defining at least one second channel; and wherein each plate has first and second slots which each extend through the plate to form a passage, each first slot extending across the plate to opposed peripheral sides of the plate and each second slot extending across the plate and not to the opposed peripheral sides, each first slot being contained in a different first channel with the opposed peripheral sides respectively being disposed on different faces of the first pair of faces and each second slot being disposed within second channel and each slot of a pair of plates which are the second pair of faces respectively defining the inlet and outlet for the second fluid.

22. A heat exchanger in accordance with claim 21 wherein:

each of the first plates are identical and each of the second plates are identical.

23. A heat exchanger in accordance with claim 21 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

24. A heat exchanger in accordance with claim 22 wherein:

the first pair of faces are parallel to each other and the second pair of faces are parallel to each other;

a plurality of first channels are disposed in the heat exchanger core with the first channels being parallel to each other; and a plurality of second channels are disposed in the heat exchanger core with the second channels being parallel to each other.

25. A heat exchanger for transferring heat between first and second fluids flowing transversely with respect to each other through a heat exchanger core comprising:

a polyhedron having a plurality of faces which define the heat exchanger core, a first pair of faces each being an inlet and an outlet for the first fluid and a second different pair of faces respectively being an inlet and an outlet for the second fluid;

a plurality of first channels extending through an interior section of the heat exchanger core between the first pair of faces for permitting the first fluid to flow between the first pair of faces with each first channel having a plurality of heat conductive walls for permitting heat exchange between the walls of each first channel and the first fluid;

means for coupling the first fluid from a first fluid source to each of the first pair of faces to cause fluid to flow in opposite directions through the first channels of the interior section when the first fluid flows from the first fluid source;

means for collecting fluid flowing from the first faces; and at least one second channel extending through the interior section of the heat exchanger core between the second pair of faces for permitting the second fluid to flow between the second pair of faces with each second channel having a plurality of heat conductive walls for permitting heat exchange between the walls of each second channel and the second fluid, each second channel being thermally coupled to each first channel and offset from each first channel.

26. A heat exchanger in accordance with claim 25 wherein:

each second channel comprises a condensing means for converting the second fluid from a gaseous state to a liquid state.

27. A heat exchanger in accordance with claim 25 wherein:

each second channel comprises an evaporating means for converting the second fluid from a liquid state to a gaseous state.

28. A heat exchanger in accordance with claim 25 wherein the heat exchanger core comprises:

a stack of a plurality of heat conductive plates, each plate having first and second slots which each extend through the plate to form a passage, each first slot extending across the plate to opposed peripheral sides of the plate and each second slot extending across the plate and not to the opposed peripheral sides, each first slot being contained in a different first channel with the opposed peripheral sides respectively being disposed on different faces of the first pair of faces and each second slot being disposed within a different second channel.

29. A heat exchanger in accordance with claim 28 wherein:

each first channel contains at least one fluid orifice disposed within the second channel for forming a jet of the first fluid as fluid passes through the at least one first channel which impinges upon a heat conductive surface within the first channel.

30. A heat exchanger in accordance with claim 29 wherein the plurality of heat conductive plates comprise:

at least one first plate with each first plate containing the first and second slots; and at least a pair of second plates with adjacent pairs of second plates facing at least one first plate and at least one second plate has at least one array of orifices containing at least one orifice, each array of orifices passing through the second plate and not extending to opposed peripheral sides of the second plate with each array of orifices being aligned in fluid communication with the second slot of an adjacent first plate.

31. A heat exchanger in accordance with claim 30 wherein:

each array of orifices contains at least one opening passing through the second plate with each opening dividing the array of orifices into subparts with each opening blocking flow of heat between subparts on both sides of the opening; and each second slot having pairs of solid portions defining an opening between opposed faces extending across the second slot each at positions such that opposed faces of the solid portions, which define each opening, are in registration with opposed sides of each opening in an adjacent second plate so that openings in adjacent first and second plates are aligned.

* * * * *